US008510872B2

(12) United States Patent
Mühlhausen et al.

(10) Patent No.: US 8,510,872 B2
(45) **Date of Patent: *Aug. 20, 2013**

(54) TOILET FLUSHER HAVING A LOW-VISCOSITY SUBSTANCE

(75) Inventors: Hans-Georg Mühlhausen, Düsseldorf (DE); Frank Pessel, Düsseldorf (DE); Ralph Butter-Jentsch, Langenfeld (DE); Matthias Lueken, Düsseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 49 days.

This patent is subject to a terminal disclaimer.

(21) Appl. No.: 12/710,388

(22) Filed: Feb. 23, 2010

(65) Prior Publication Data

US 2010/0205726 A1 Aug. 19, 2010

Related U.S. Application Data

(63) Continuation of application No. PCT/EP2008/054204, filed on Apr. 8, 2008.

(30) Foreign Application Priority Data

Aug. 24, 2007 (DE) ..... 10 2007 040 329

(51) Int. Cl.
*E03D 9/02* (2006.01)

(52) U.S. Cl.
USPC ..... 4/223; 4/231; 239/310

(58) Field of Classification Search
USPC ..... 4/222, 223, 224, 225.1, 226.1, 227.1, 4/228.1, 231, 232; 222/135, 63; 239/310, 239/311; 137/268
See application file for complete search history.

(56) References Cited

U.S. PATENT DOCUMENTS

| | | | | |
|---|---|---|---|---|
| 2,545,755 | A * | 3/1951 | Harold Ward | 422/124 |
| 3,946,448 | A * | 3/1976 | Sioufy | 4/223 |
| 4,670,916 | A * | 6/1987 | Bloom | 4/231 |
| 5,251,340 | A * | 10/1993 | Su-Land | 4/304 |
| 5,457,822 | A * | 10/1995 | Klammsteiner | 4/223 |
| 5,584,079 | A * | 12/1996 | Wong et al. | 4/226.1 |
| 6,898,806 | B2 * | 5/2005 | Keramidas | 4/231 |
| 7,603,726 | B2 * | 10/2009 | Sawalski et al. | 4/223 |
| 2005/0047956 | A1 * | 3/2005 | Samii | 422/5 |

(Continued)

FOREIGN PATENT DOCUMENTS

| | | |
|---|---|---|
| DE | 10113036 A1 | 6/2002 |
| EP | 0775741 A1 | 5/1997 |

(Continued)

*Primary Examiner* — Gregory Huson
*Assistant Examiner* — Janie Christiansen
(74) *Attorney, Agent, or Firm* — David LeCroy; Christopher S. Andrzejak

(57) ABSTRACT

Toilet flusher (1) comprising a power source (3), a control unit (4), and at least one first container (9) containing a first preparation (10), wherein the first container can be coupled to the toilet flusher (1), wherein at least the first preparation (10) has a viscosity less than 3,000 mPas, and wherein a pump (6) and/or a dispensing element (43) is configured so that when the pump (6) is idle or the dispensing element (43) is in the closed position, the preparation (10) is prevented from freely flowing into the surrounding area.

17 Claims, 17 Drawing Sheets

(56) References Cited

U.S. PATENT DOCUMENTS

| | | | | |
|---|---|---|---|---|
| 2005/0273918 | A1* | 12/2005 | Bernarducci | 4/231 |
| 2006/0091160 | A1* | 5/2006 | Sweeton | 222/333 |
| 2007/0136937 | A1 | 6/2007 | Sawalski et al. | |
| 2009/0194562 | A1 | 8/2009 | Kessler et al. | |

FOREIGN PATENT DOCUMENTS

| | | | |
|---|---|---|---|
| EP | 1808537 | A1 | 7/2007 |
| FR | 2588742 | A1 | 4/1987 |
| WO | 9638637 | A1 | 12/1996 |

* cited by examiner

TOILET FLUSHER HAVING A LOW-VISCOSITY SUBSTANCE

CROSS REFERENCE TO RELATED APPLICATIONS

The present invention is a continuation of International Patent Application No. PCT/EP2008/054204 filed 8 Apr. 2008, which claims priority to German Patent Application No. 10 2007 040 329.3 filed 24 Aug. 2007, both of which are incorporated herein by reference.

The invention relates to a toilet freshener having an electromechanically induced release of a low-viscosity active substance preparation in and/or on a toilet bowl.

Precise dosing of flowable or free-flowing compositions in accordance with demand is relevant for a variety of fields of application.

In the household area, dosing of flowable substances has gained increasing importance, based primarily on precise and demand-controlled dosing of active substances so that, firstly, the surrounding environment is protected through conservation of resources and avoidance of overdosing and misdosing and, secondly, efficacy of the active ingredients thereby dosed is optimized.

Dosing of cleaning compositions and perfume compositions in the toilet area is currently implemented by so-called toilet fresheners. These are single-chamber or multichamber containers which are suspended in the toilet bowl in such a way that an active ingredient is released from the toilet freshener into the toilet bowl when flushing the toilet bowl with water.

Such devices are known from EP 0828902 or DE 10113036, for example.

One important disadvantage of these toilet fresheners is that dosing depends essentially on the respective local flow conditions in the toilet bowl during the flushing operation. However, these flow conditions may vary greatly, depending on the type of toilet and the positioning of the toilet freshener in and/or on the toilet bowl. For example, with some types of toilets, it may happen that no active substances are released from the toilet freshener because insufficient water or none at all flows over the toilet freshener during the flushing operation and therefore the dosing mechanism of the toilet freshener is not triggered.

Furthermore, if flushing water overflows a toilet freshener when used, this may result in a disturbance in the water guidance intended by the toilet manufacturer reducing the flushing power of the toilet.

It is therefore desirable to have a dosing device for the release of active substances into a toilet bowl that implements dosing of active substances into the toilet bowl in a manner independent of the toilet flushing operation.

Furthermore, it is desirable if the active ingredient is released not only after activation of flushing. For example, it would be advantageous to dose perfumes or sudsing agents into the toilet bowl immediately prior to use of the toilet as a preventive measure against the possible release of odoriferous substances of human metabolic excretory products, which are often perceived as unpleasant, during use of the toilet.

Furthermore, dosing devices referred to herein often have a large structural volume which is esthetically displeasing and often poses functional problems because the usable space in a toilet bowl is reduced due to the dosing devices hanging into the toilet opening.

Additionally, liquid toilet fresheners are known which release an active substance preparation having a viscosity of >3000 mPas. This viscosity is necessary either because of the release mechanism of such fresheners and/or the sealing of the freshener to prevent unintended leakage of the active ingredient preparations.

However, accurate and rapid dosing is difficult because of the comparatively low flow rates of active ingredient preparations having such a high viscosity.

A defined, constant dosing of the active ingredient compositions in accordance with demand is of increasing importance, especially with regard to cleaning of toilet bowls in an environmentally friendly.

The present invention addresses these issues by providing a toilet freshener which implements a defined, accurate and rapid dispensing of active ingredients from a toilet freshener into a toilet bowl.

This is achieved by a toilet freshener comprising a power source, control unit, and at least one container containing at least a first preparation, wherein the container can be coupled to the toilet freshener. The power source, control unit and the at least one container cooperate in such a way that when there is a predetermined sensor signal at the control unit, the at least first preparation is dispensed from the at least one container to the surrounding environment. Further, the at least first preparation has a viscosity lower than 3000 mPas, and one pump and/or a release element is configured so that free flow of the preparation into the surrounding environment is prevented when the pump is stopped and/or the release element is in the closed position.

According to the invention, the at least first preparation has a viscosity less than about 3000 mPas. A pump and/or a release element is configured so that when the pump is stopped and/or in the closed position of the release element, free flow of the at least first preparation into the surrounding environment is prevented.

With the combination of a viscosity of the at least first preparation of less than 3000 mPas with the dosing device, a much more rapid and accurate dispensing of the preparation is possible.

Because of the better miscibility of air and preparation, it is possible to create stable foam on the surfaces of the toilet bowl.

Although the viscosity of the preparation is lower than that found in the prior art, through a suitable embodiment of the pump and/or the release element, free flow of the preparation and thus unintended leakage of the preparation out of the dosing device are prevented.

The inventive toilet freshener consists of various components which can be combined to form modules. Components of the toilet freshener include at least one pump, a release element, a control unit, a sensor unit, a power source, a container, a fastening means and a preparation. In a preferred embodiment of the invention, the pump, control unit, sensor unit and power source components may be combined to form the "dosing device" module. The components and modules are described below.

Dosing Device—

The power source needed for operation of the toilet freshener, a control unit, a sensor unit and at least one pump can be integrated into the dosing device. The dosing device preferably includes a splash-proof housing, which prevents splashing water, which may occur when using the inventive toilet freshener in a toilet bowl, from penetrating into the interior of the dosing device.

Furthermore, it is preferable for the dosing device to be situated on the outer edge of the toilet bowl, thus protecting against the effects of splashing water while also permitting convenient operation of the dosing device. Furthermore, the dosing device does not protrude into the interior of the toilet, so the usable cross-sectional area of the toilet bowl is not reduced by its arrangement on the outer edge of the bowl.

Since dosable preparations can have a pH between 2 and 12, depending on intended application, those components of the toilet freshener which come in contact with the preparations should have a corresponding acid resistance and/or alkali resistance. Furthermore, through a suitable choice of materials, these components should be largely chemically inert (e.g., inert with respect to nonionic surfactants, enzymes and/or perfumes).

In a preferred embodiment, the electric components of the inventive toilet freshener (e.g., the power source, the control unit and the sensor) are cast separately or jointly with one another so that the dosing device is substantially watertight (i.e., the dosing device is functional even when completely surrounded with liquid). Useful casting materials include multicomponent epoxy and acrylate casting compounds, such as methacrylate esters, urethane methacrylates and cyanoacrylates or two-component materials with polyurethanes, silicones, epoxy resins.

An advantage of the invention is the separation of the toilet freshener into a dosing device and a container couplable to the dosing device, so the toilet freshener may be used in a flexible manner for a wide variety of application cases and may be adapted easily.

Pump—

A pump according to the present application is a fluid energy machine moving or conveying small quantities of a fluid, in particular by conversion of a mechanical drive power into a fluid power.

Fluids refer to liquids and gases as well as mixtures thereof and with solids.

Useful pumps include displacement pumps, oscillating pumps, diaphragm pumps, piston pumps, rotary pumps, dynamic pumps, centrifugal pumps, electrohydrodynamic pumps, electro-osmotic pumps, magnetohydrodynamic pumps, surface-acoustic-wave pumps, capillary force pumps, electrowetting pumps, and thermocapillary pumps.

The pump can be connected to the power source either directly or with the control unit in between.

In another embodiment of the invention, dispensing of at least one preparation is induced by gravity alone without action of a pump. Dispensing of the preparation from the container to the surrounding environment in this configuration is controlled by a valve, for example, which opens to release the preparation and is closable to prevent dispensing. The valve can be controllable directly by the power source or by the control unit connected in between.

The pump, sensor and control unit are advantageously configured in such a way that a defined dispensing quantity of active ingredient preparation is dispensed into the toilet bowl independent of the arrangement of the toilet freshener in or on the toilet bowl and/or the quantity of flushing water acting on the toilet freshener.

By means of the pump, it is also possible for at least two different defined dispensing quantities of at least one active ingredient preparation to be releasable. An important advantage of this embodiment of the invention is the dosing of active ingredients into the toilet bowl on demand so that more effective use of active ingredients in a manner that is more conservative with resources may be induced.

In another preferred embodiment of the invention, the pump is configured so that it is suitable for release of an active substance preparation having a viscosity of <3000 mPas.

Micropump—

The delivery rate of a micropump is usually from 50 mL to 100 mL per minute, preferably from 250 mL to 30 mL per minute, especially preferably from 500 mL to 5 mL per minute.

The micropump preferably has a structural volume of less than 5 $cm^3$, especially preferably less than 3 $cm^3$, in particular preferably less than 2 $cm^3$.

The specific delivery rate of a micropump, based on the ratio of the delivery rate to the structural volume of a micropump, is usually less than 500 (1/min). The specific delivery rate is preferably from 1 to 300, especially preferably from 1.5 to 200, in particular preferably from 2 to 150, most especially preferably from 2.5 to 100.

Diaphragm Pumps

Diaphragm pumps are particularly advantageous for dosing of cleaning preparations and active ingredient preparations as well as perfumes.

Diaphragm pumps usually comprise an inlet valve into and an outlet valve out of a pump chamber, formed in part by a pump diaphragm, and an actuator.

The actuator induces compression of the pump chamber by mechanical action on the pump diaphragm when the intake valve is closed so that fluid in the pump chamber is delivered out of the pump chamber through the opened outlet valve.

If the ejection operation is concluded, the outlet valve is closed and decompression of the pump chamber is induced by the actuator, allowing fluid to be drawn into the pump chamber through the opened intake valve.

Through a suitable configuration and/or control of the valves and the actuator, the direction of conveyance of the micropump may be influenced and/or reversed.

The actuator of the diaphragm pump can be chosen from electromotor, piezoceramic, bimetallic, memometallic, pneumatic, peristaltic, electrostatic, electromagnetic and thermal drive units, for example.

The valves can be active or passive valves. Passive valves include flap valves, diaphragm valves or no-moving-parts valves.

Depending on the field of application, dispensing of the preparation from the dosing device on the pressure side may be accomplished by drop, stream, spray, diffusion or evaporation.

For preparations which form deposits during prolonged storage, it may be advantageous to arrange the container holding the preparation on the pressure side of the pump. In this configuration, only a fluid free of deposit-forming substances is conveyed through the pump. In this case, it is particularly advantageous to use air as the fluid.

The fluid is pumped into the container under pressure. The container has a pressure-equalizing valve which releases the product flow out of the container when a defined pressure in the container is exceeded.

It is possible to use the dosing device for a wide variety of preparations without endangering the functionality of the pump due to possible deposits or reactions between two preparations.

Release Elements—

Release elements can be any type of devices suitable for dispensing an active substance to the surrounding environment of the dosing device.

Release elements include nozzles, spray heads, drop dosing devices, foam spray heads, piezo elements, porous elements, wick systems, capillary systems, atomizers, ultrasonic atomizers, ionizing atomizers, etc.

For dispensing active substances into the toilet and/or the inside surfaces of the toilet bowl, nozzles, spray heads, drop dispensers, foam spray heads, piezo elements and the like are particularly suitable.

For dispensing active ingredient preparations into the air, nozzles, nebulizers, spray heads, piezo elements, sintered plates, porous elements, wick systems and the like are suitable.

Release elements can have the same or different spray cone shapes for dispensing the preparations. For example, it is conceivable for one release element to create a jet having a point-shaped application area, while another release element creates a planar application field. Various combinations of a wide variety of spray cone shapes are also conceivable.

The release element can be movably arranged on the toilet freshener so that a user can direct the spray cone created by the release element onto a desired application field. The release element can also have means which allow the spray cone shape to be adjusted.

The release element can also provide for electrostatic charging of active ingredient droplets so that wetting, adhesion and/or distribution of the active ingredient on a surface and/or in the air is/are improved.

Furthermore, the release element can be designed as a fan configured either for improving the air through intake of foul odors or with regard to an optimized distribution of active substance in and/or on the toilet bowl.

The release elements may in particular be configured so that one or more active substances are dispensed in different directions from one another. A few possible configurations with regard to the dispensing direction are listed as examples in the following table, although not intended to be conclusive.

| Dispensing direction A | Dispensing direction B |
|---|---|
| Perfume dispensed into the toilet bowl | Perfume dispensed into the surroundings |
| Cleaning agent dispensed into the toilet bowl | Cleaning agent dispensed below the edge of the toilet/during flushing or outside of the flushing operation |
| Cleaning agent dispensed into the toilet bowl | Perfume dispensed into the surroundings |

Other desirable combinations of the configurations listed in the above table are also possible.

Furthermore, it is advantageous to movably arrange the release element on the bracket of the toilet freshener. In this way, the release element and the spray cone of the preparation can be directed by a user in a targeted manner to wet a defined application field in or on the toilet with the preparation.

The release element(s) is/are advantageously configured in such a way that a defined dispensing quantity of at least one active ingredient preparation is directed independent of the positioning of the toilet freshener on the toilet bowl, and is applied to the interior of the toilet bowl in a defined manner. Advantages of such an embodiment include more specific exposure of the toilet bowl surfaces to one or more active ingredients so that different surfaces may be treated with different active substances. For example, in the case of a flat freshener, the pan may be wetted with an active ingredient to prevent deposits while an active ingredient to prevent lime deposits is applied to the walls running in a funnel shape from the pan to the edge of the toilet.

In another preferred embodiment of the invention, the control unit generates a control signal for release of the active ingredient preparation when flushing water is triggered, and a control signal for terminating the release of active ingredient when the flow of flushing water through the toilet bowl is terminated.

In an advantageous further development of the inventive toilet freshener, the first quantity dispensed and at least the second quantity dispensed originate from the same or different active ingredient preparations.

According to another preferred embodiment, the first dispensing quantity and at least the second dispensing quantity are released at different times.

In another advantageous embodiment of the invention, the release element and at least the first preparation are configured so that foam is formed with release of the preparation into the surrounding environment.

In another alternative embodiment of the invention, the pump, release element and at least the first preparation are configured so that foam is formed with release of the preparation into the surrounding environment.

Formation of foam has many possible advantages. First, foam can enclose bad odors especially well due to its pore and cell structure. Second, foam may also be applied as a so-called "anti-caking" coating to the surface of the toilet bowl to reduce adhesion of metabolic excretory products on these surfaces.

It is advantageous here if the release element is designed as a foam spray head and the preparation has a viscosity of less than 3000 mPas, yielding fine-pored foam that adheres well and is as stable as possible.

Control Unit—

A control unit according to the present application is a device suitable for influencing conveyance of material, power and/or information. The control unit therefore influences converters with information which it processes in the sense of the control goal.

Converters include, for example, pumps and/or valves.

Since the toilet freshener does not use any mechanical control elements to release the product according to a preferred embodiment of the invention, the toilet freshener can be miniaturized so that it may also be used in applications in which the size of the toilet freshener is critical.

The control unit in particular can be a programmable microprocessor. In a particularly preferred embodiment of the invention, a plurality of dosing programs are stored in the microprocessor which are selectable and executable in accordance with the container coupled to the toilet freshener. It is also conceivable for the dosing programs to be manually retrievable by the user.

The control unit is preferably also arranged on the toilet bowl facing outward so that it can be easily operated by the user, in particular when the user is sitting on the toilet.

In a particularly preferred embodiment of the invention, the control unit may comprise a dosing program for introducing at least two different active substance preparations into a toilet bowl or into the surrounding environment of the toilet bowl, in which at least two different active substance preparations are released in at least two successive times $t_1$ and $t_2$, at least one active substance preparation being introduced into the interior of a toilet bowl.

An important advantage of such a dosing program includes an optimized cleaning power due to extremely accurate control of possible chemical reactions through a suitably time-offset release of the corresponding preparation or preparations, a few examples of which are listed in the following table, although it is not conclusive.

| $t_1$ | $t_2$ | Advantage |
|---|---|---|
| Cleaning agent in the toilet bowl in the flushing operation | Perfume in the toilet bowl after the flushing operation | Optimized release of perfume because the perfume is released into the toilet bowl after the flushing operation and therefore is not flushed away with the flushing water. The perfume is not "destroyed" by the cleaning agent preparation. |
| Perfume in the toilet bowl immediately before use | Cleaning agent in the toilet bowl during the flushing operation | Optimized release of perfume because the perfume is released into the toilet bowl before the flushing operation and therefore is not flushed away with the flushing water. The perfume is not "destroyed" by the cleaning agent preparation. |
| Cleaning agent A in the toilet bowl immediately before use | Cleaning agent B in the toilet bowl during the flushing operation | Cleaning agent A may prevent deposits in the toilet bowl by forming a protective film of cleaning agent A in the toilet bowl immediately before use of the toilet, this film then being flushed from the toilet surface during the process of flushing cleaning agent B. |

Another advantage is that a controlled release of one or more different perfumes can be implemented, thereby at least reducing dependence on the sense of smell. This can be accomplished by a clocking procedure and pulsed dispensing of perfume as described in the art. Furthermore, dependence on smell can also be reduced by dispensing different perfumes in succession.

The toilet freshener can also dose a defoaming agent into the toilet bowl before or during the flushing operation. Excessive foaming before or during the flushing operation often causes toilet paper to float on this foam so that it is not properly flushed away with the flushing water, but instead floats in the toilet bowl even after the flushing operation has completed. This is unattractive to the consumer. By dosing the defoaming agent before or during the flushing operation, excessive foaming is prevented and reliable disposal of toilet paper is ensured. In addition or as an alternative to the defoaming agent, substances that dissolve cellulose may also be added.

The control unit can be designed so that parameters in the dosing programs are adjustable. For example, sensor threshold values can be adjusted during preconfiguration of the toilet freshener, or by the user during use to trigger release of active ingredient at a certain sensor threshold value. The setting of one or more parameters can be implemented by a suitably configured input device on the toilet freshener. In this way, control of the toilet freshener can be further optimized and adapted to a certain application case.

Sensor Unit—

The sensor unit can include one or more active and/or passive sensors for qualitative and/or quantitative detection of mechanical, electric, physical and/or chemical variables sent as control signals to the control unit.

In particular, sensors of the sensor unit include timers, infrared sensors, brightness sensors, temperature sensors, motion sensors, strain sensors, rpm sensors, proximity sensors, flow rate sensors, color sensors, gas sensors, vibration sensors, pressure sensors, conductivity sensors, turbidity sensors, alternating sound pressure sensors, lab-on-a-chip sensors, force sensors, acceleration sensors, inclination sensors, pH sensors, moisture sensors, magnetic field sensors, RFID sensors, magnetic field sensors, Hall sensors, biochips, odor sensors, hydrogen sulfide sensors and/or MEMS sensors.

The sensor in its simplest conceivable embodiment can also be embodied as a tilt sensor, pressure sensor or touch sensor.

For preparations whose viscosity fluctuates greatly as a function of temperature, it is advantageous for the volume and/or mass control of the dosed preparations to provide flow rate sensors in the dosing device. Suitable flow rate sensors include diaphragm flow rate sensors, magnetic-inductive flow meters, mass flow rate measurement according to the Coriolis method, eddy counter flow rate measurement methods, ultrasonic flow rate measurement methods, particulate flow rate measurement, ring-piston flow rate measurement, thermal mass flow rate measurement or active pressure flow rate measurement.

It is also conceivable to store a viscosity curve as a function of temperature for at least one preparation in the control unit, so that dosing is adjusted by the control unit in accordance with the temperature and thus the viscosity of the preparation.

In another embodiment of the invention, a device for direct determination of the viscosity of the preparation is provided.

The alternatives mentioned above for determining the dosing quantity and/or viscosity of a preparation serve to generate a control signal, which is processed by the control unit for control of a pump, whereby constant dosing of a preparation is induced.

In another preferred embodiment of the invention, the sensor is configured so that detection of a flushing operation is implemented without any significant influence on the flow conditions in the toilet bowl. For example, ultrasonic sensors may be used for this purpose.

Furthermore, it is advantageous if in a dosing operation a defined quantity of a preparation is dispensed in a time of less than 20 seconds, preferably less than 20 seconds, particularly preferably less than 5 seconds. With a dosing interval which is as short as possible, during which a preparation is dispensed to the surrounding environment, the dosing device can be available promptly for the next dosing interval and also ensure an effective dispensing of preparation with ongoing use.

Power Source—

According to the present application, the power source is understood to be a component of the dosing device, which is expedient for providing power suitable for self-sufficient operation of the dosing device.

The power source preferably supplies electricity. The power source can be, for example, a battery, a power pack, solar cells or the like.

It is also possible to transmit the electricity required for operation of the dosing device wirelessly to the device by radio waves from a corresponding transmitter to a corresponding receiver.

It is particularly advantageous to design the power source to be replaceable (e.g., in the form of a replaceable battery).

However, it is also possible for the power source to be a mechanical power source such as a dynamo, which converts mechanical or fluid energy into electricity. This can then be stored in suitable storage elements such as a capacitor or battery.

Container—

A container according to the present application refers to a packaging suitable for enclosing or holding preparations and can be coupled to the dosing device for dispensing the preparation.

An arrangement comprising two containers, preferably separate from one another, with each containing an active ingredient fluid, is especially preferred. However, multiple storage containers for multiple active ingredient fluids may also be provided. The storage containers are separated from one another in order to suppress premature mixing of the active ingredient fluids. They can be designed to be physically separate or as separate components in a cohesive body.

The volume ratio formed from the structural volume of the dosing device and the filling volume of the container preferably is <1, especially preferably <0.1, in particular preferably <0.05. With a predefined total structural volume of the dosing device and the container, the predominant proportion of the structural volume is provided by the container and the preparation contained therein.

The container usually has a filling volume of <5000 mL, in particular <1000 mL, preferably <500 mL, especially preferably <250 mL, most especially preferably <50 mL.

The invention is suitable for dimensionally stable containers such as cups, tins, cartridges, bottles, canisters, cans, boxes, drums or tubes, but can also be used for flexible containers such as bags or sacks, in particular when used according to the bag-in-bottle principle.

A container can also have multiple chambers which can be filled with different compositions. It is also possible for a plurality of containers to be arranged to form one unit (e.g., a cartridge).

Examples of possible combinations of containers and/or chambers having the corresponding preparations are summarized in the following table for a few applications.

| Container A | Container B | Container C |
|---|---|---|
| Cleaning agent | Perfume | |
| Cleaning agent A | Cleaning agent B | |
| Cleaning agent A | Cleaning agent B | Perfume |

In a preferred embodiment, the container has an RFID label containing at least information about the contents of the container, readable by the sensor unit.

This information can be used to select a dosing program stored in the control unit. By doing so, optimal dosing program for each preparation is always used. It is also possible that no dosing is performed by the dosing device when no RFID label is present or when an RFID label bears a false or defective identifier and, instead for an optical or acoustic signal to be generated, alerts the user to the presence of an error.

To rule out misuse of the containers, the containers may also have structural elements which cooperate with corresponding elements on the dosing device according to a lock-and-key principle, so that only containers of a certain type are coupled to the dosing device, for example. Furthermore, with this embodiment it is possible for information about the container coupled to the dosing device to be transmitted to the control unit so that the dosing device can be controlled in a manner coordinated with the contents of the corresponding container.

In another embodiment of the invention, the container may be under pressure. This is advantageous when the preparation is sprayed or dispensed without requiring a pump in between. In this case, the preparation can be dispensed, for example, in a manner that is controlled and/or regulated by a control valve operatively connected to the control unit. This embodiment has the additional advantage that no power need be supplied by the power source for conveying the preparation, so the power source can either be designed with smaller dimensions or have a longer lifetime.

Fasteners—

The toilet freshener can additionally comprises fasteners for affixing the toilet freshener to the toilet bowl. Fasteners include suction cups, adhesive tape, brackets or the like, for example.

Alternatively, the toilet freshener may also be attached to the tank of the toilet, the toilet seat or the toilet lid. Fasteners known in the art can be used here.

Preparations—

Preparations according to the present application are compositions containing at least one substance from the group of cleaning agents and/or perfumes.

According to another preferred embodiment of the invention, preparations include substances for modification of surfaces, in particular, ceramic surfaces.

Preparations suitable according to the invention include, for example, scent phases, in particular perfumed scent phases. Such scent phases usually contain at least one perfume, preferably perfume oil, at least one surfactant or one emulsifier, water and optionally additional ingredients such as preservatives, thickeners, chelating agents, dyes, additional surfactants or emulsifiers, stabilizers, lime dissolvers, etc.

Bleach phases, in particular chlorine-containing bleach phases, preferably hypochlorite-based bleach phases, are likewise suitable as preparations according to the invention, wherein the bleach phases can contain additional ingredients such as thickeners, surfactants or emulsifiers, neutralizers, dyes, perfumes, etc., in addition to the actual bleaching agent and/or water.

Additional preparations suitable according to the invention include lime-dissolving active ingredient phases, preferably acidic lime-dissolving active ingredient phases. These lime-dissolving active substance phases can contain additional ingredients such as surfactants or emulsifiers, thickeners, perfumes, preservatives, etc. in addition to the actual lime-dissolving agent—which is preferably an organic or inorganic acid—and water.

It is also possible to use as preparations highly concentrated surfactant phases, so-called suds boosters. Such highly concentrated surfactant phases can also contain additional conventional ingredients besides surfactants. Suds boosters are advantageous in pretreating the toilet bowl with a carpet of foam, for example, to prevent and/or reduce adherence of metabolic excretory products to the toilet surface and/or to induce encapsulation of bad odors.

Optionally also suitable according to the invention are preparations having an antibacterial and/or fungicidal and/or antiviral active substance phase, where the active substance phase can optionally contain, in addition to the antibacterial and/or fungicidal and/or antiviral active substance and water, additional ingredients such as surfactants or emulsifiers, thickeners, perfumes, preservatives, etc.

It is also possible for the preparations to have enzyme-containing active substance phases. Such enzyme-containing active substance phases can optionally contain, in addition to enzyme(s) and water, additional ingredients such as surfactants or emulsifiers, thickeners, perfumes, preservatives, etc.

It is likewise possible for the preparations used according to the invention to be absorbent active phases, in particular odor-absorbing active phases. In addition to the absorbent, in particular odor absorbents and water, these preparations may contain additional ingredients, if necessary, such as surfactants or emulsifiers, thickeners, perfumes, preservatives, etc.

According to an especially preferred embodiment, the inventive toilet freshener offers the possibility of using combinations of different preparations in the storage containers, such that one of the storage containers contains a scent phase as defined above.

Examples of useful preparation combinations include perfumed scent phases in combination with chlorine bleaches (which are not stable when stored together), perfumed scent phases with a highly concentrated surfactant phase (suds booster), scent phases with a lime-dissolving acidic active substance phase, scent phases combined with an antibacterial active substance phase, various acid systems, scent phase combined with an enzyme-containing active substance phase, perfumed acid phase combined with a water-tinting phase, scent phase with an odor-absorbing phase, perfumed acid phase with active oxygen, perfumed acid phase with an active substance phase, thickened with polyacrylate, etc.

Of particular interest are liquid to viscous active substance fluids having a viscosity in the range of a few thousand mPas, in particular from 200 to 3000 mPas, preferably 500 to 3000 mPas (measured with a RotoVisko LVTV II, spindle 31, 5 rpm, 20° C.).

In another preferred embodiment of the invention, the preparations have a viscosity of less than 3000 mPas, in particular less than 1000 mPas (measured with a RotoVisko LVTV II, spindle 31, 5 rpm, 20° C.). Such low-viscosity to aqueous preparations are suitable in particular when the preparation is to be sprayed in or on the toilet bowl.

Due to the use of low-viscosity active substance preparations, much faster and more accurate dosing is inducible in combination with the inventive toilet freshener, and no thickener systems need be used. Furthermore, active substance systems, which may be prepared only with a low viscosity (e.g., based on chlorine, HCl, etc.), may also be used.

According to another embodiment of the invention, the preparation can be under pressure. This is advantageous when the preparation is sprayed or dispensed without requiring a pump in between. In this case, dispensing of the preparation can be controlled and/or regulated by a control valve operatively connected to the control unit. This embodiment has the additional advantage that no power need be supplied by the power source for conveying the preparation, so the power source can be designed with smaller dimensions or to have a longer lifetime.

FIG. **4*a*** is a schematic block diagram of an embodiment of a toilet freshener according to the present invention having an actively valve-controlled two-chamber preparation container on the intake side of the pump.

Figure 5:
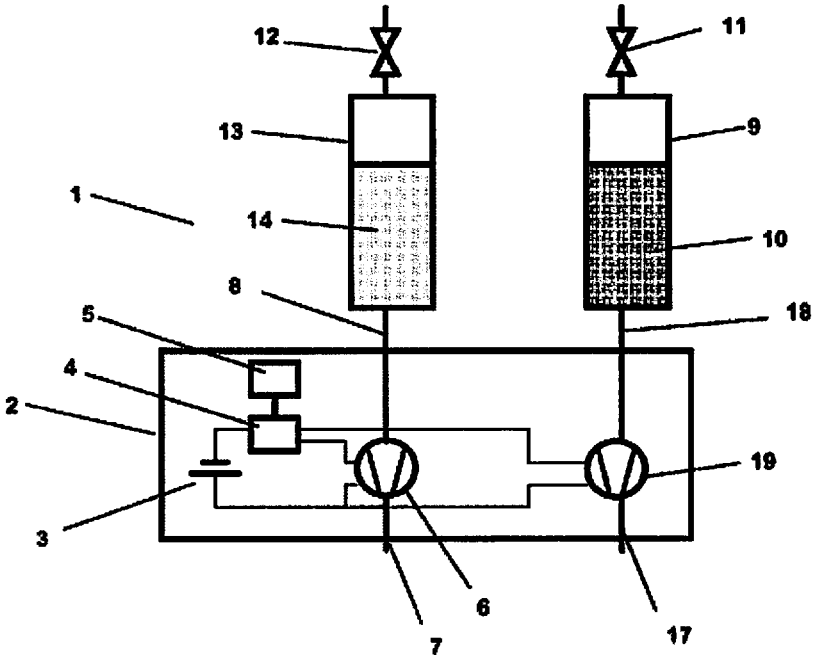

FIG. 5 is a schematic block diagram of an embodiment of a toilet freshener according to the present invention having two pump-connected preparation containers.

Figure 6:
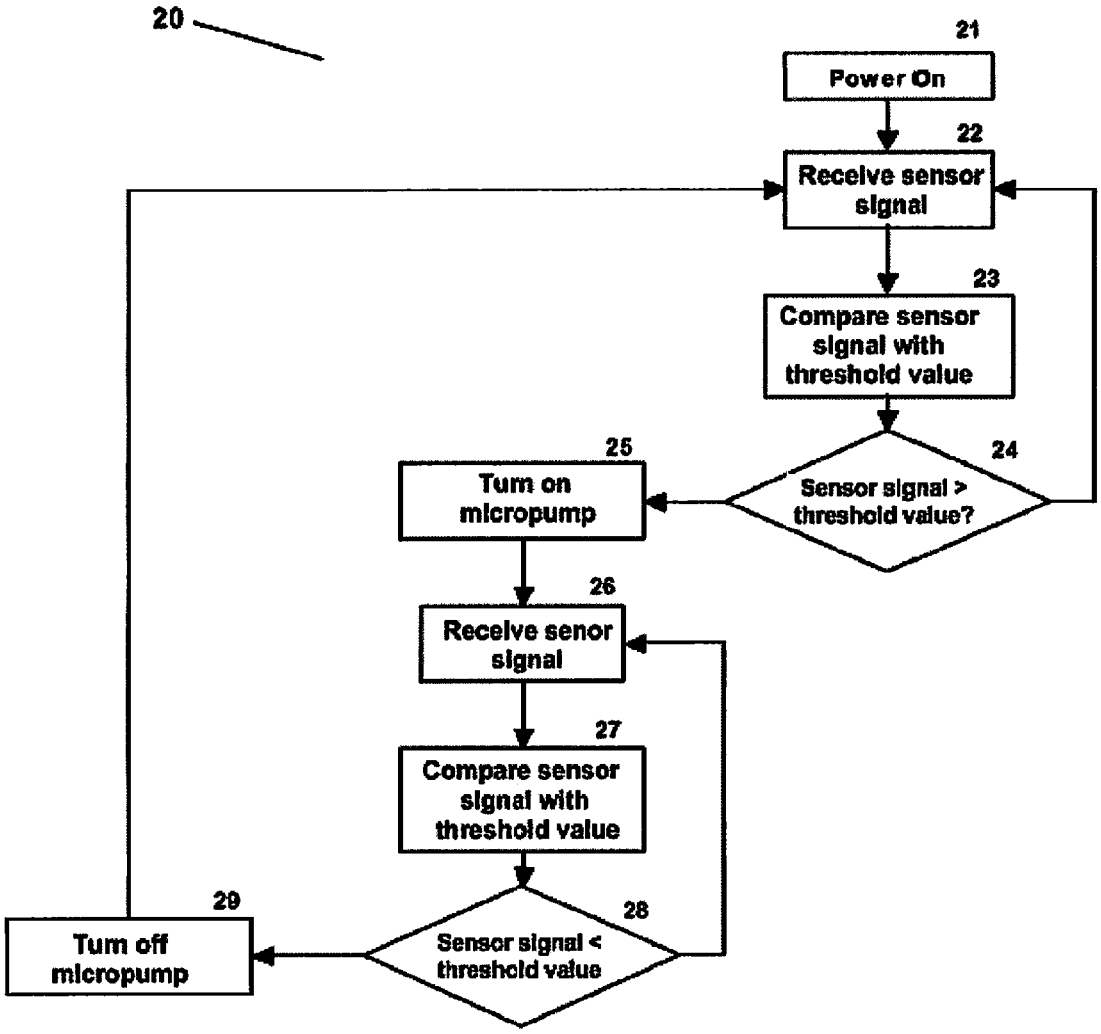

FIG. 6 is a flow chart illustrating a method of controlling a toilet freshener according to the present invention with a pump.

Figure 7:
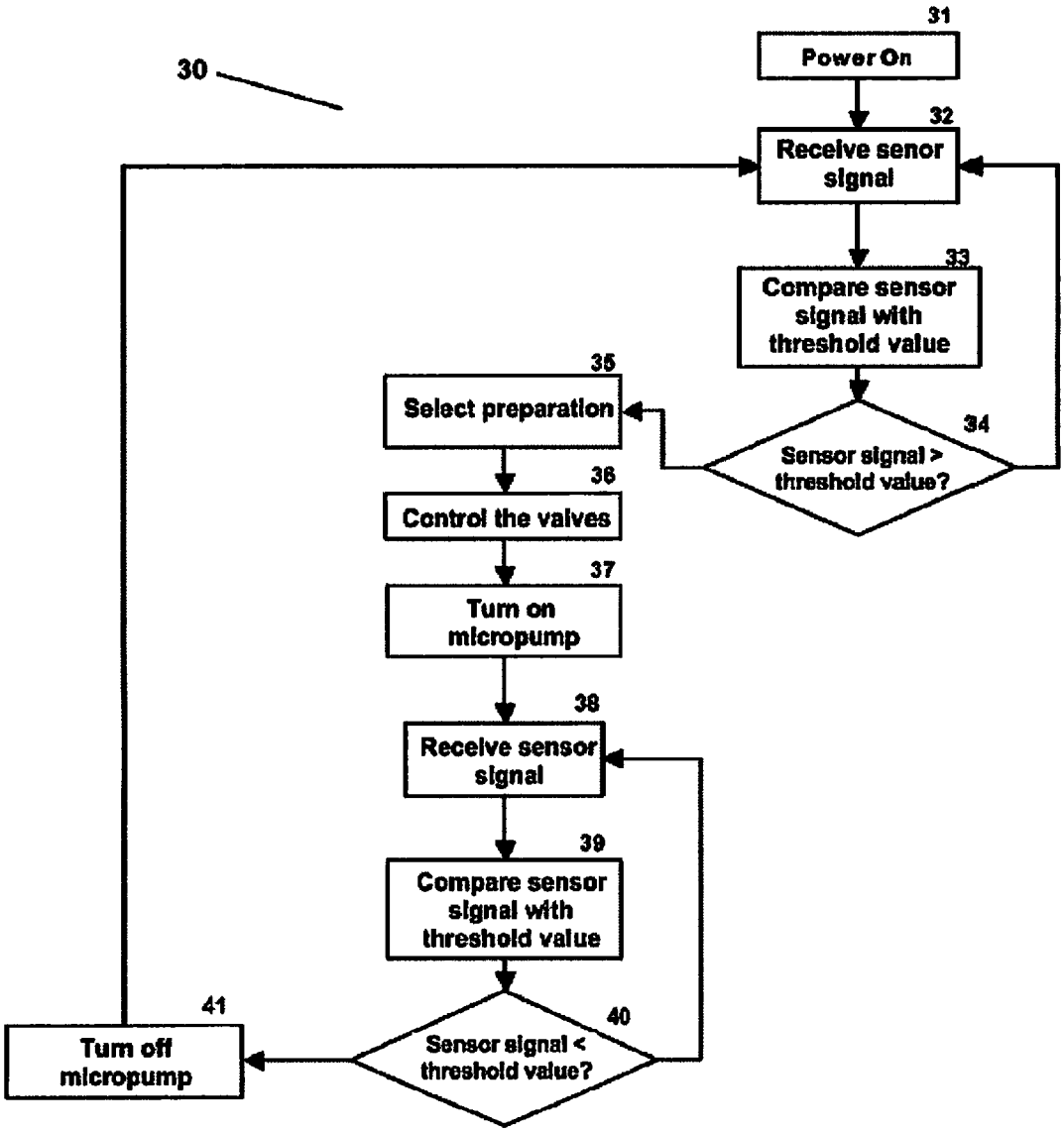

FIG. 7 is a flow chart illustrating a method of controlling a toilet freshener having a pump and a multichamber preparation container.

Figure 8:
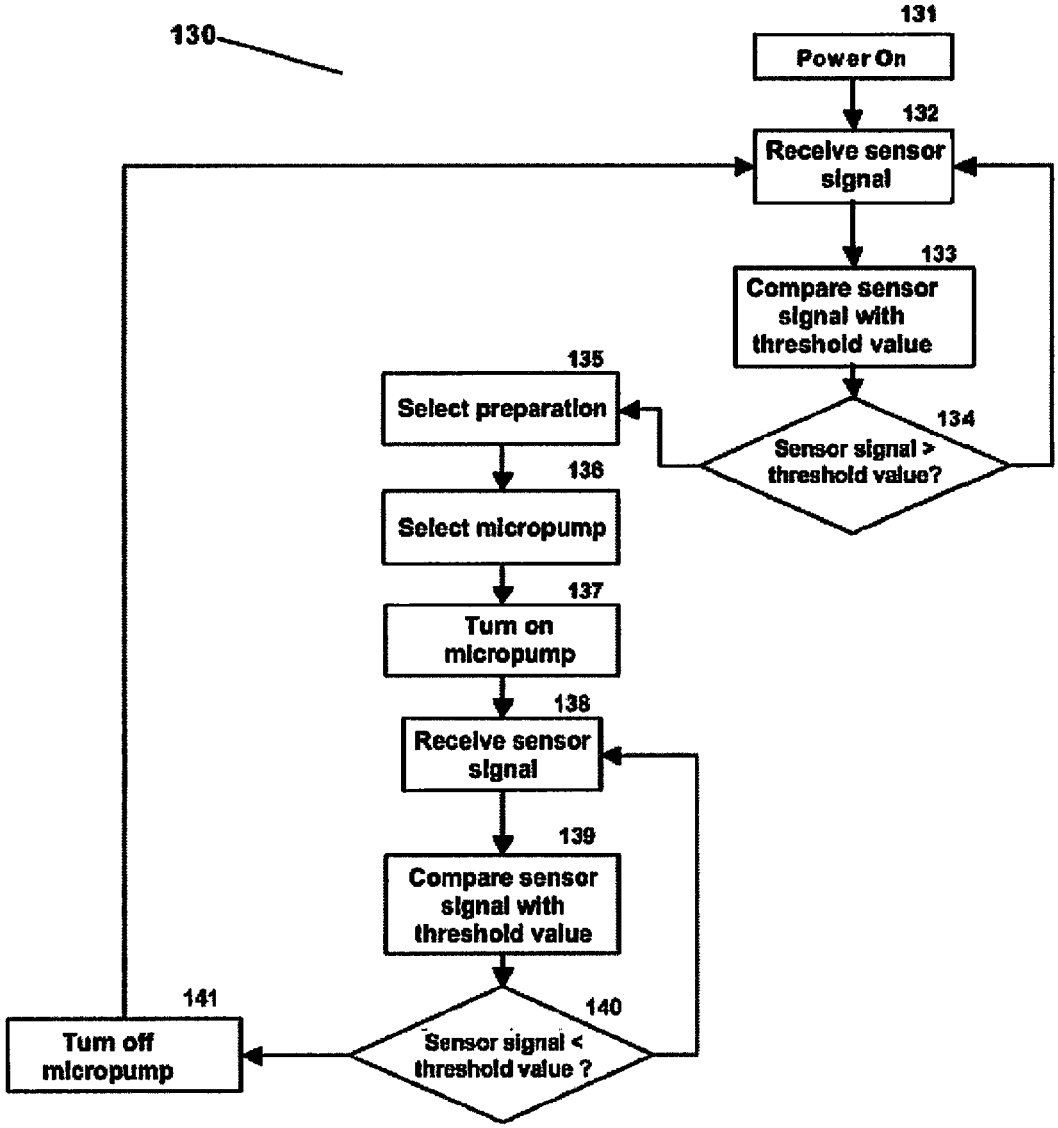

FIG. 8 is a flow chart illustrating a method of controlling a toilet freshener having multiple pumps and a multichamber preparation container.

Figure 9:
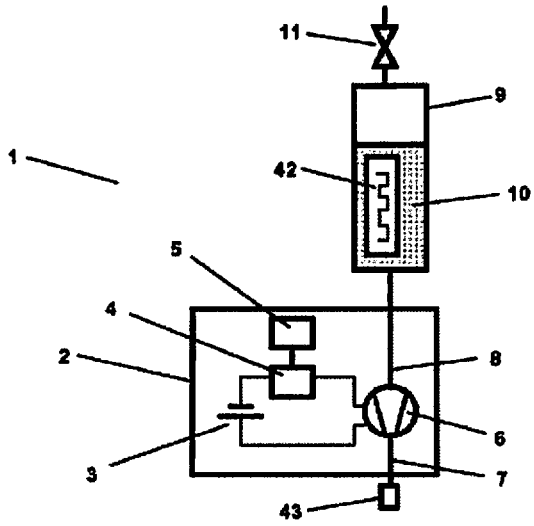

FIG. 9 is a schematic block diagram of an embodiment of a toilet freshener according to the present invention having RFID label on a preparation container.

Figure 10:
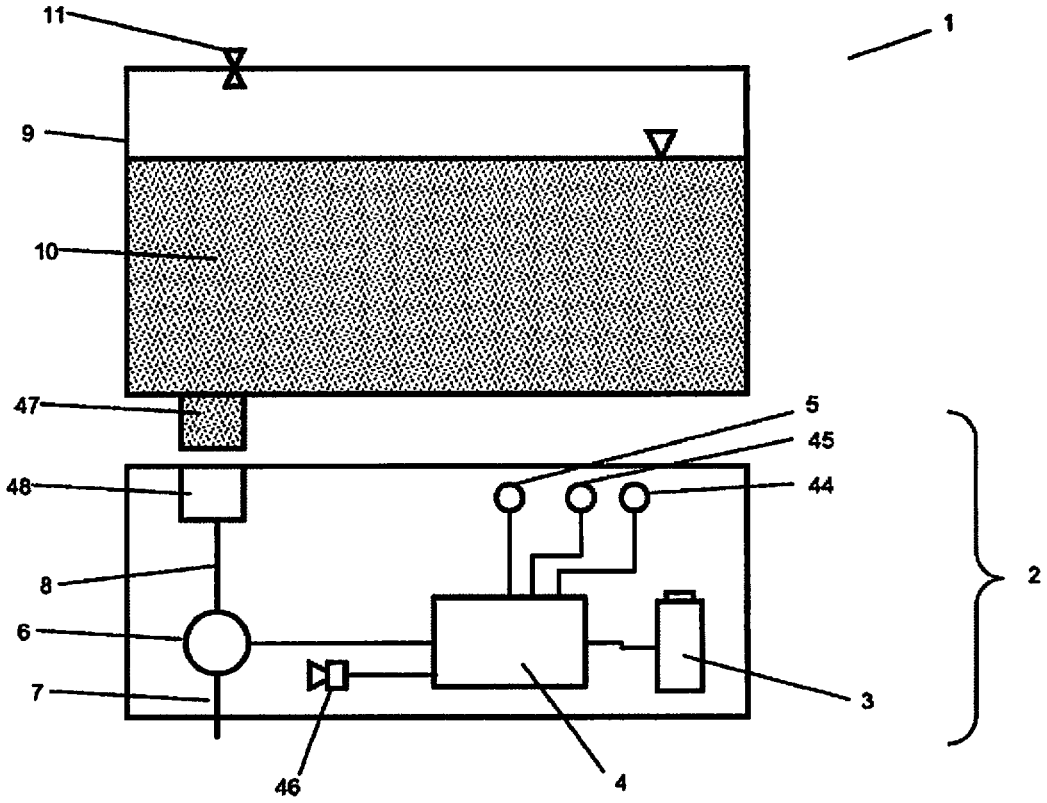

FIG. 10 is a schematic block diagram of an embodiment of a toilet freshener according to the present invention having a removable refilling container.

Figure 11:
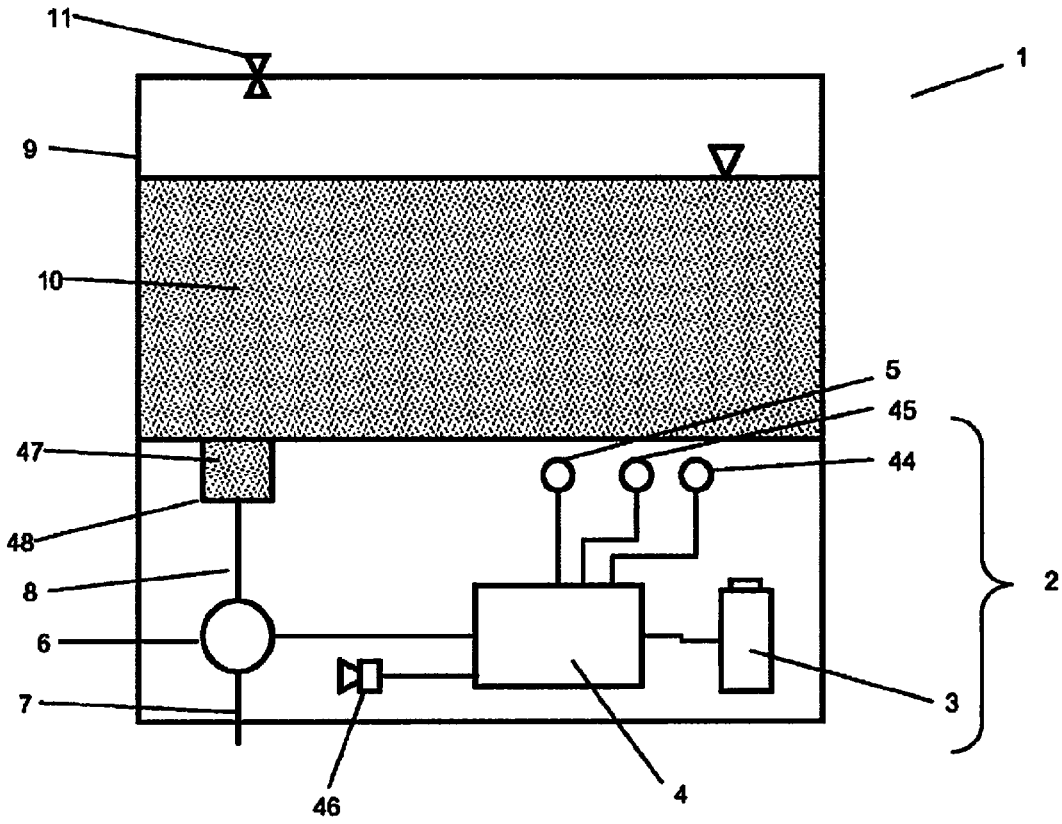

FIG. 11 is a schematic block diagram of an embodiment of a toilet freshener according to the present invention having a refilling container attached to the dosing device.

Figure 12:
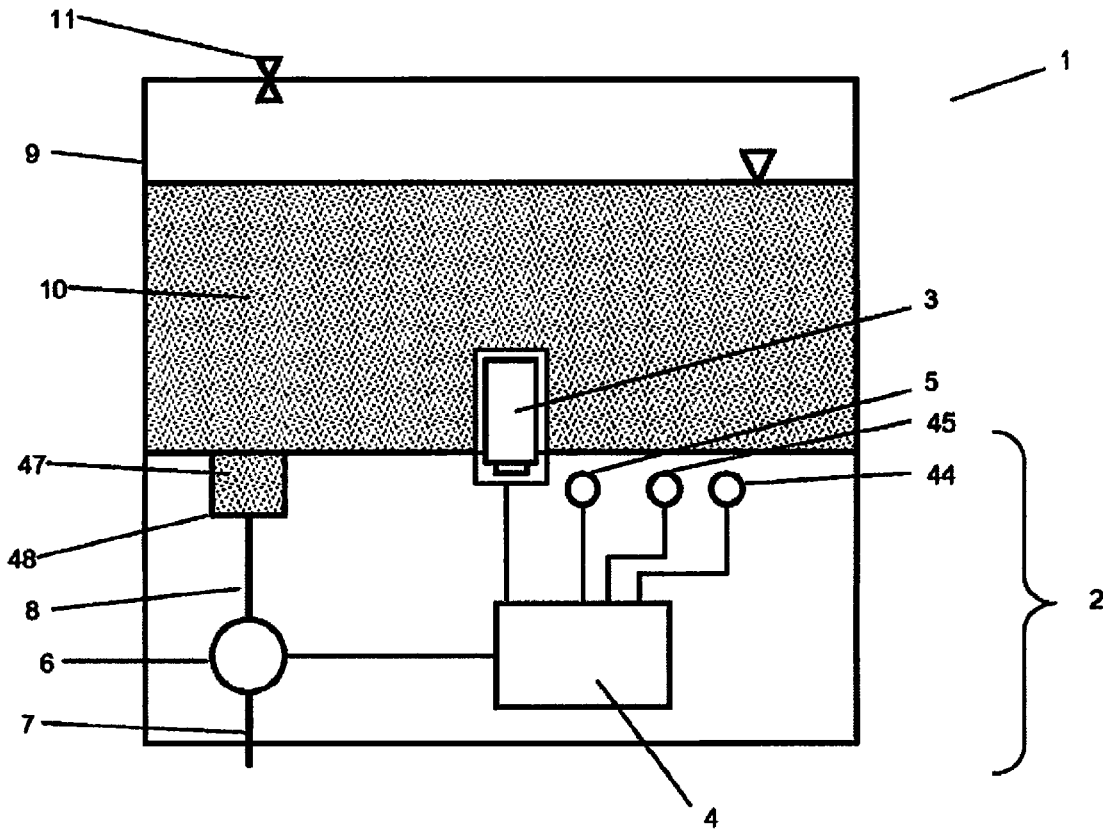

FIG. 12 is a schematic block diagram of an embodiment of a toilet freshener according to the present invention having a battery integrated into the refilling container.

Figure 13:
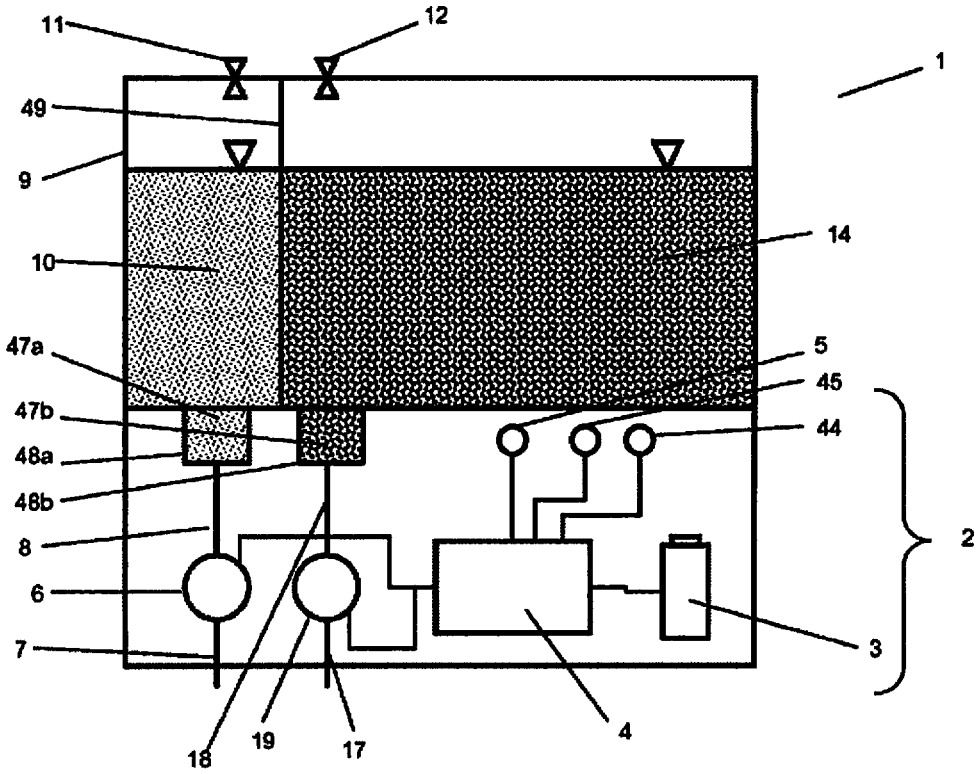

FIG. 13 is a schematic block diagram of an embodiment of a toilet freshener according to the present invention having a two-chamber refilling container and two pumps.

Figure 14:
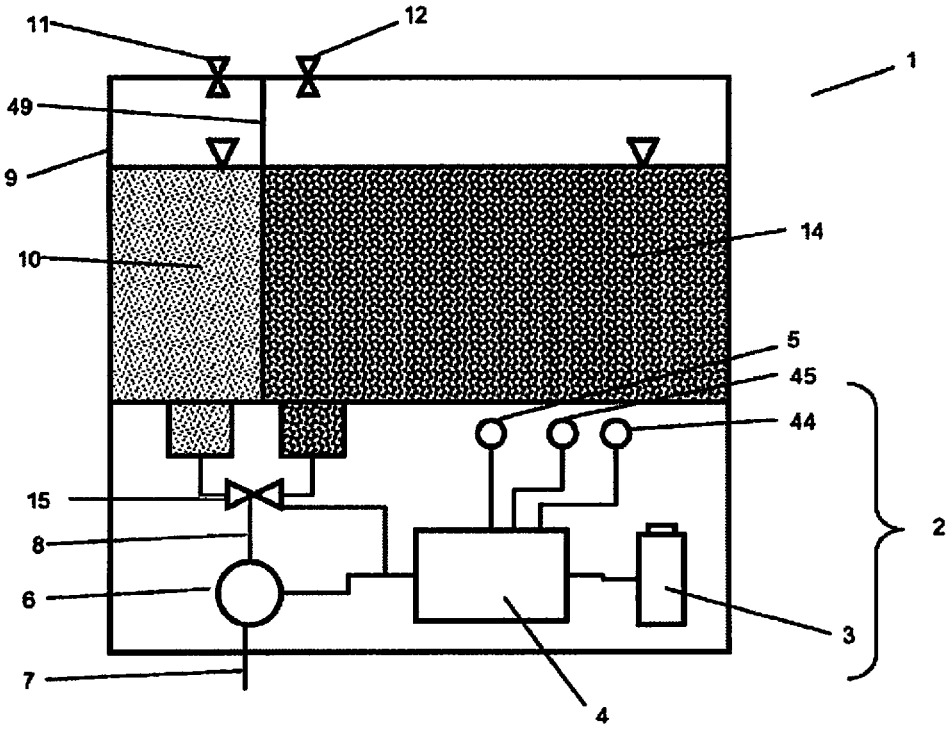

FIG. 14 is a schematic block diagram of an embodiment of a toilet freshener according to the present invention having a two-chamber refilling container, a pump and a control valve.

Figure 15:
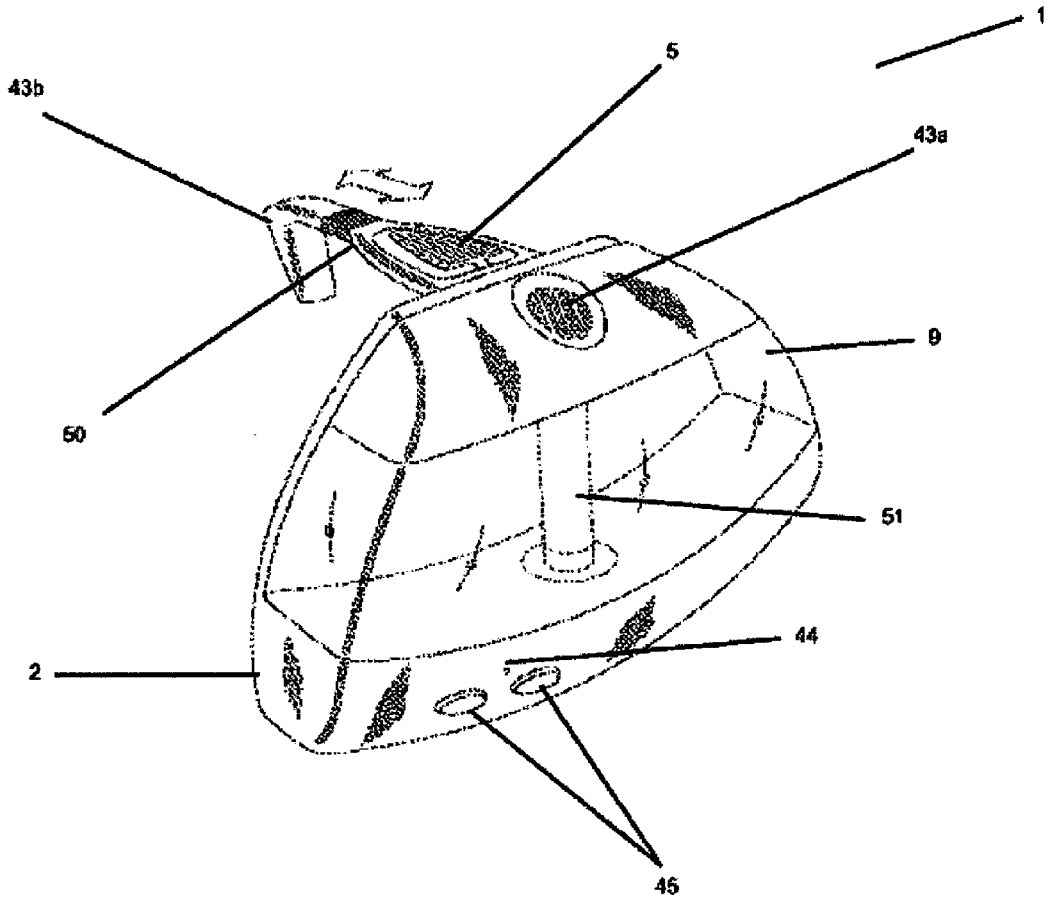

FIG. 15 is a perspective view of an embodiment of a toilet freshener according to the present invention having an extendable bracket.

Figure 16:
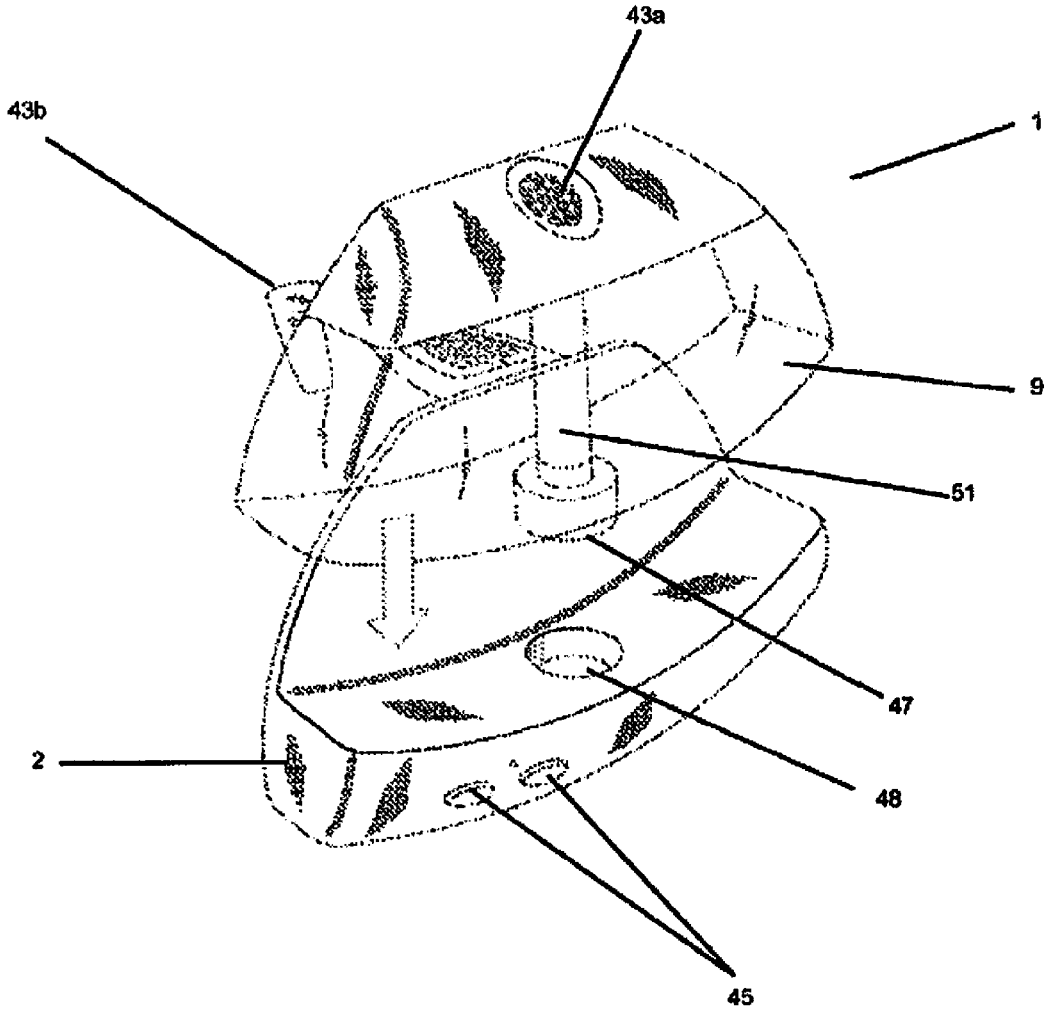

FIG. 16 is a perspective view of an embodiment of a toilet freshener according to the present invention having a removable container and wick system.

Figure 17:
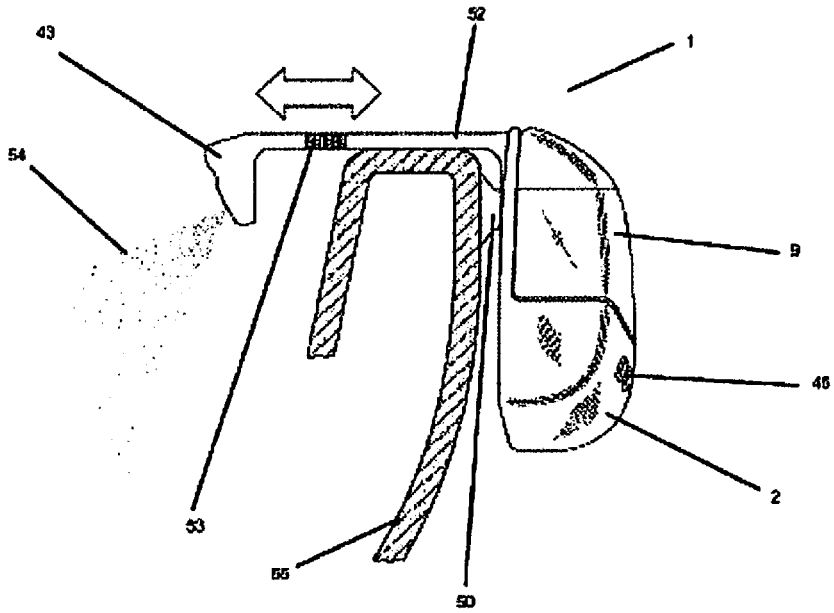

FIG. 17 is a side view of an embodiment of a toilet freshener according to the present invention having a release element arranged on a bracket end.

Figure 18:
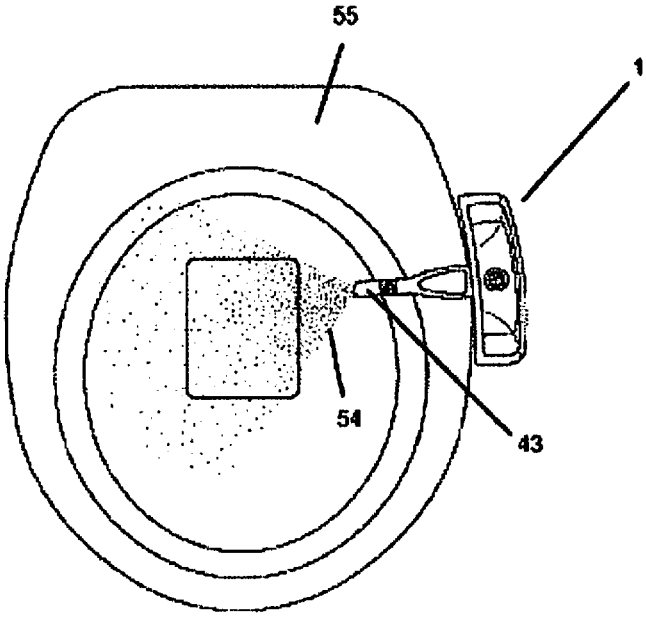

FIG. 18 is a top view of an embodiment of a toilet freshener according to the present invention having a release element arranged on a bracket end attached to a toilet bowl.

Figure 19:
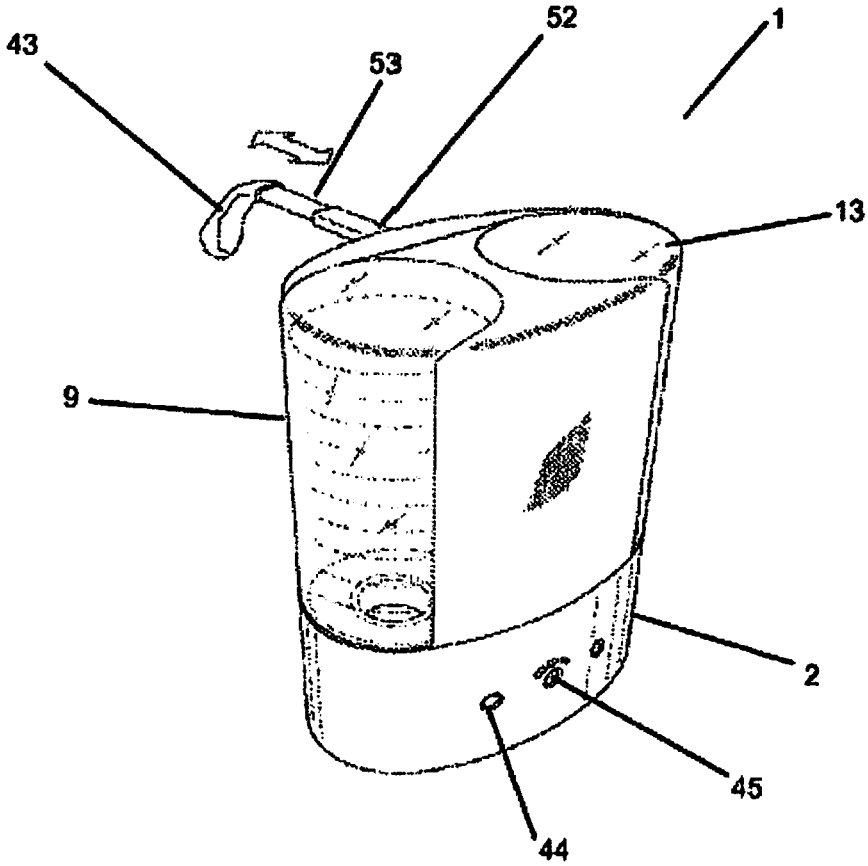

FIG. 19 is a perspective view of an embodiment of a toilet freshener according to the present invention having individually replaceable containers.

Figure 20:
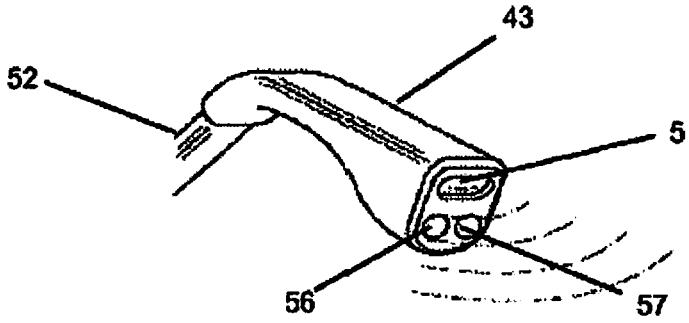

FIG. 20 is a perspective view of an embodiment of a release element according to the present invention having an integrated sensor unit and two dispensing nozzles.

Figure 21:
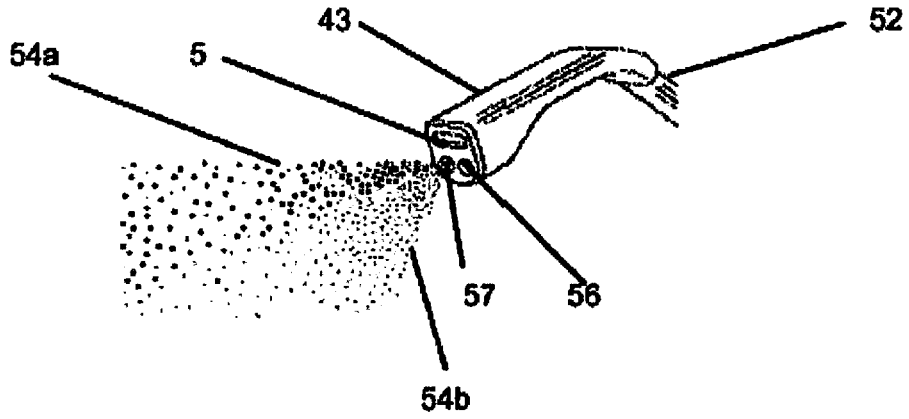

FIG. 21 is a perspective view of an embodiment of a release element according to the present invention having an integrated sensor unit, two dispensing nozzles and two spray cones.

Figure 22:
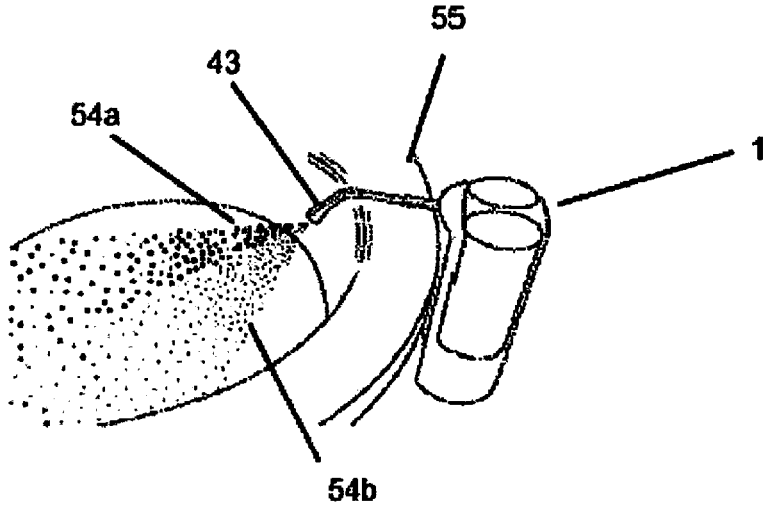

FIG. 22 is a perspective view of an embodiment of a toilet freshener according to the present invention having a release element and two spray cones attached to a toilet bowl.

Figure 23:
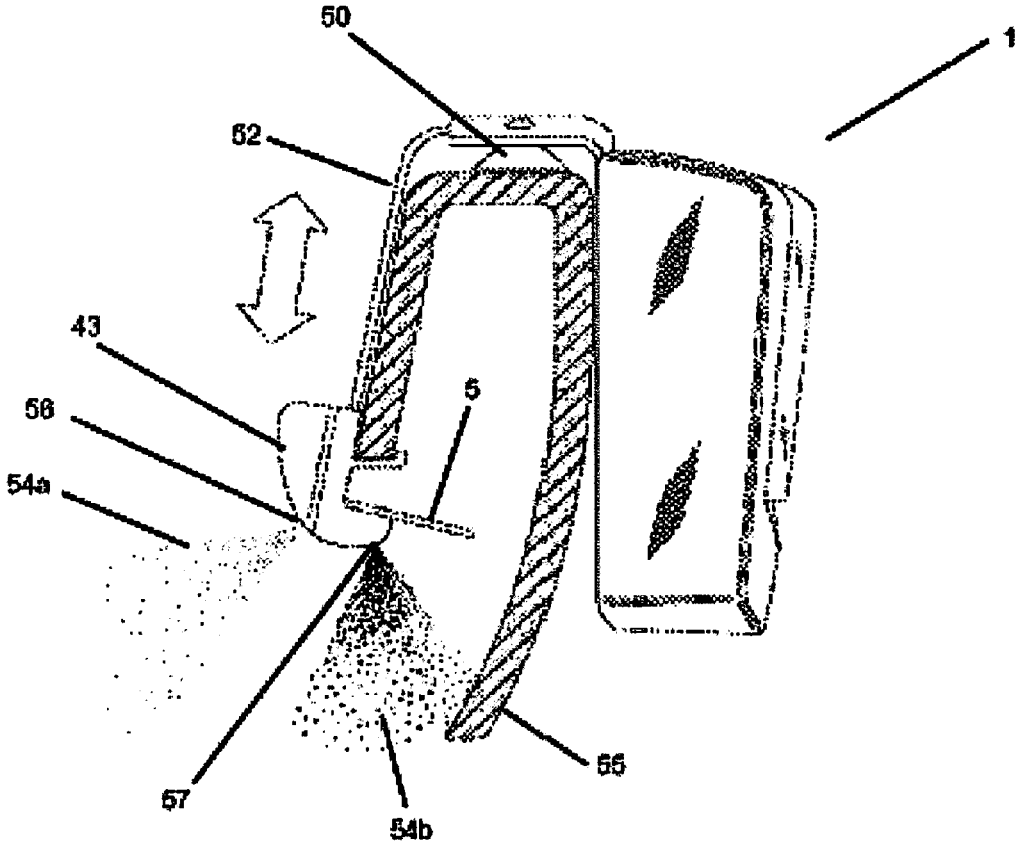

FIG. 23 is a side view of an embodiment of a toilet freshener according to the present invention having a release element arranged beneath the toilet edge and two differently oriented spray cones.

Figure 24:
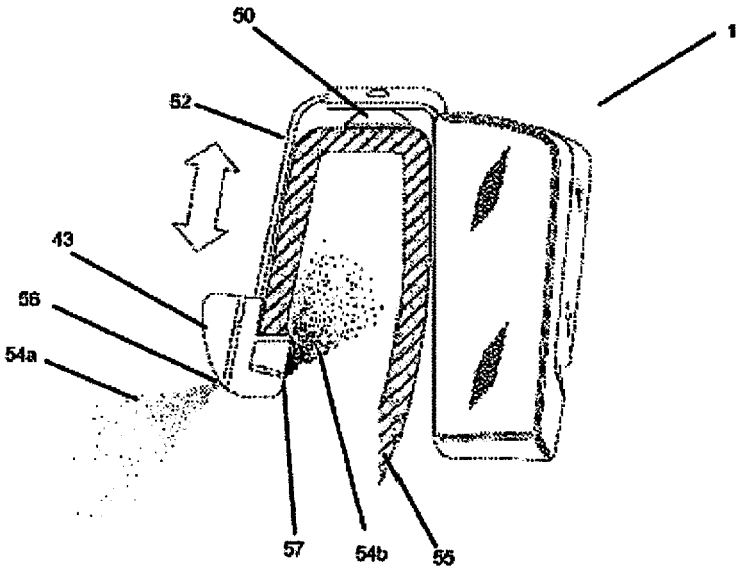

FIG. 24 is a side view of an embodiment of a toilet freshener according to the present invention having a release element arranged beneath the toilet edge and a spray cone directed beneath the edge of the toilet.

Figure 25:
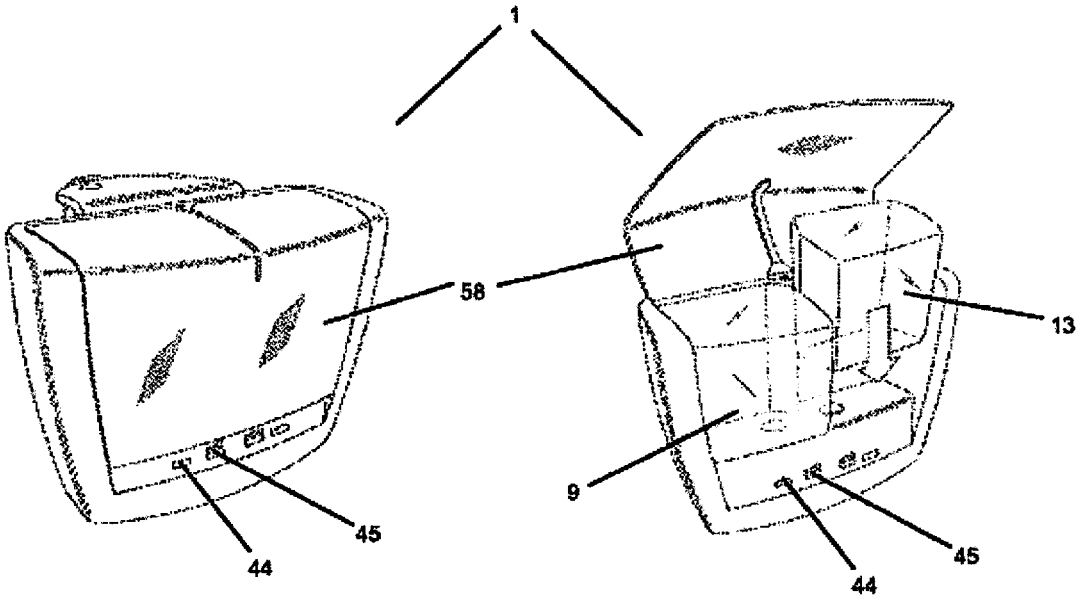

FIG. 25 is a perspective view of an embodiment of a toilet freshener according to the present invention having two individually replaceable containers and an inspection flap in a closed position and in an opened position.

Figure 1:
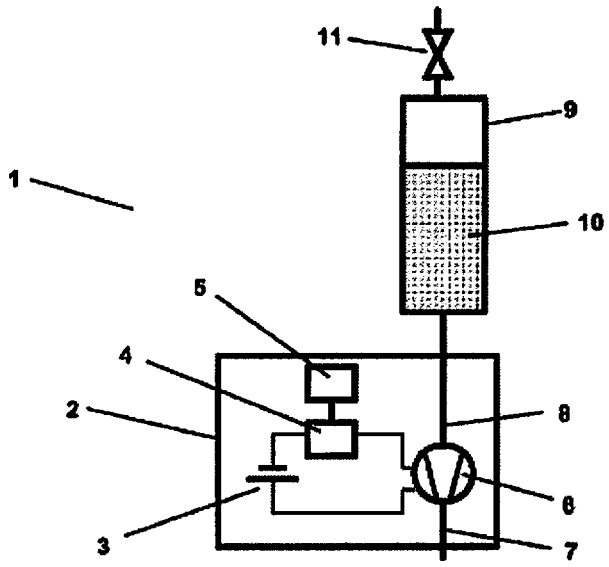
FIG. 1 is a schematic block diagram of one embodiment of a toilet freshener according to the present invention having a preparation container on the intake side of the pump.

FIG. 1 shows the inventive toilet freshener 1 consisting of the dosing device 2 and a container 9 connected to the dosing device 2 and containing a preparation 10.

The dosing device 2 includes a power source 3, control unit 4, sensor unit 5 and pump 6, preferably arranged in a housing. The pump 6 is connected to the power source 3 via the control unit 4. The control unit 4 is in turn connected to the sensor unit 5, which sends control signals for controlling the pump 6 to the control unit 4.

The pump 6 has a pressure line 7 and an intake line 8, with the intake line 8 connected to the container 9 containing the preparation 10. The pump 6 thus delivers the flowable preparation 10 through the intake line 8 out of the container 9 into the pressure line 7, from which the preparation 10 is dispensed to the surrounding environment of the toilet freshener 1. The pressure line 7 can be configured so that it counteracts gelation of the preparation dispensed (e.g., by choice of a suitable diameter).

The container 9 can have a pressure-equalizing valve 11 for inducing an equalization of pressure between the surrounding environment and the interior of the container 9 when the pump 6 pumps the preparation 10 out of the container 9.

The pump 6 can be triggered by the control unit 4 so that the direction of conveyance of the pump is reversed and any preparation still present in the pump 6 and lines 7 and 8 is delivered back into the container 9. This backflushing can be advantageous when the preparation 10 thickens, clogging the lines 7 or 8.

Figure 2:
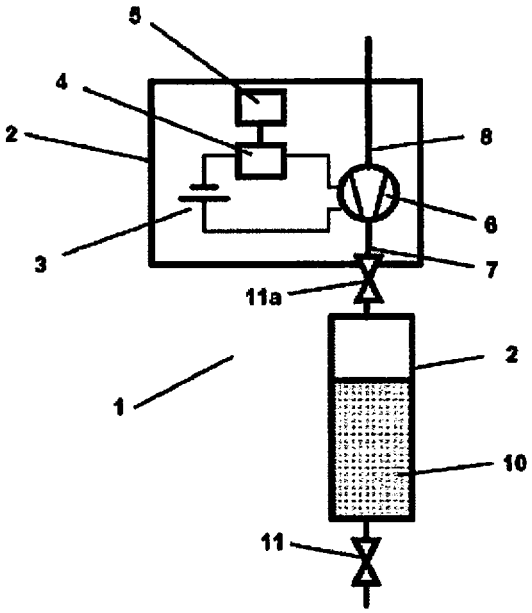
FIG. 2 is a schematic block diagram of another embodiment of a toilet freshener according to the present invention wherein the freshener has a preparation container on the pressure side of the pump.

FIG. 2 shows another embodiment of the dosing device known from FIG. 1 in which the container 9 is connected to the pump 6 on the pressure side. Here the pump 6 builds up pressure in the container 9 by pumping ambient air into the container 9, thereby displacing the preparation out of the container 9. A valve 11 can be provided on the preparation output side of the container 9, enabling dispensing of the preparation 10 out of the container 9 when a defined pressure is reached in the container 9. This can be advantageous when there is a defined spray stream or spray mist dosing instead of dropwise dosing.

In addition, a nonreturn valve 11*a* can be provided in the pressure line 7 between the pump 6 and the container 9, preventing pressure built up in the container 9 from escaping through the pressure line 7 when the pump 6 is stopped.

Figure 3:
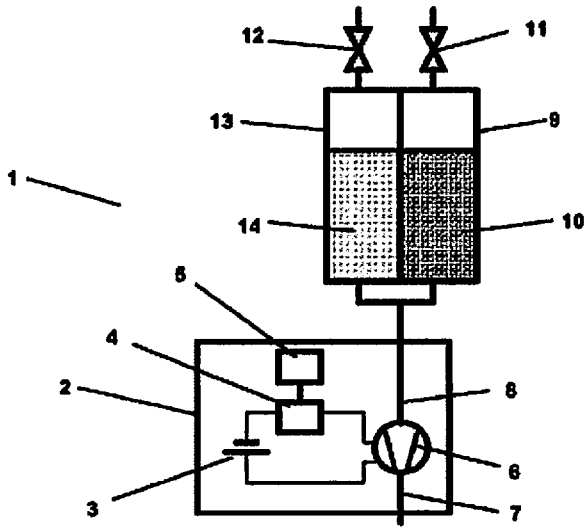
FIG. 3 is a schematic block diagram of an embodiment of a toilet freshener according to the present invention having a two-chamber preparation container on the intake side of the pump.

FIG. 3 shows the dosing device 2 known from FIG. 1 wherein a two-chamber container formed from the containers 9 and 3 is connected to the intake line 8 of the pump 6. The containers 9 and 13 can each contain different compositions 10 and 14.

The containers 9 and 13 can each have pressure-equalizing valves 11, 12.

The output openings on the bottom sides of the containers 9 and 13 are connected to the intake line 8 and to the pump 6 so that the preparations 10 and 14 are pumped through the intake line 8 in defined ratios to one another. It may be necessary here for flow conditions in the pressure lines 8 leading to the output openings in the bottom sides of the containers 9 and 13 to be designed accordingly.

When using more than two different preparations 10 and 14, it is advantageous to control the dosing so that two compatible preparations are transferred one after the other through the lines 7, 8 and the pump 6.

Incompatibility of two preparations can be due, for example, to an exothermic reaction, thickening, flocculation, a change in pH, a color change or the like.

In addition, a third container containing a flushing fluid that cleans the lines 7, 8 and the pump 6 of at least one of the preparations 10, 14 can also be provided. Air can also be provided for flushing the lines 7, 8 and the pump 6. By flushing the lines 7, 8 and the pump 6, it is possible to prevent residues of incompatible preparations from coming in mutual contact.

Figure 4:
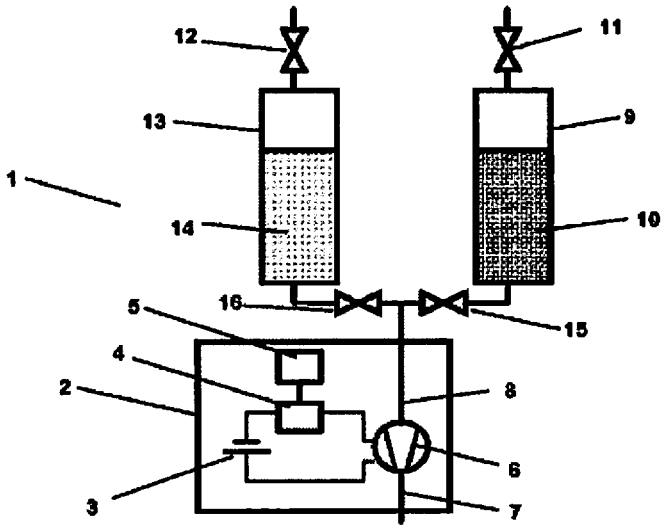
FIG. 4 is a schematic block diagram of an embodiment of a toilet freshener according to the present invention having a passively valve-controlled two-chamber preparation container on the intake side of the pump.

FIG. 4 shows a further embodiment of the toilet freshener 1 known from FIG. 3. The pressure lines 8 leading to the output openings on the bottom sides of the containers 9 and 13 each have a passive valve 15 and 16, allowing a defined setting of the dosing ratios of the preparations 10 and 14 out of the containers 9 and 13.

The valves 15 and 16 may also be designed as temperature-sensitive bimetal valves that open and/or close at a defined temperature. In particular, the valves 15 and 16 can be different bimetal valves so that, for example, on reaching a defined temperature, only one preparation can be conveyed by the pump 6 out of one of the containers 9 or 13.

The dosing devices according to FIGS. 1-4 all have a control unit 4 that regulates the pump 6 by processing signals from the sensor unit 5.

FIG. 6 shows a basic control algorithm 20 in the form of a flow chart.

The control algorithm 20 is activated as soon as the dosing device 2 is turned on. The control unit 4 receives signals from the sensor unit 5 in a first process step 22. In the control unit 4, the received sensor signal is compared with a threshold value stored in the control unit 4.

In the subsequent process step 24, there is a check on whether the sensor signal and the threshold value are in a defined ratio to one another on the basis of a selection condition. If this condition is met, the pump 6 is activated by process step 25. If this condition is not met, sensor signals according to process step 22 are additionally received by the control unit and evaluated.

As can be seen from process steps 25-29, the pump 6 remains in an activated state until a sensor signal is obtained that causes the micropump to be deactivated based on comparison with a threshold value stored in the control unit 4. According to this procedure, preparation is pumped from the containers as long as the sensor signal varies between two predefined threshold values for activating and deactivating the pump 6.

Alternatively, it is also possible for the control described in the introduction to be modified so that a simple trigger circuit is implemented in which activation of the micropump according to process step 25 results in dispensing of a defined quantity of preparation, so that the micropump is automatically turned off without requiring any additional deactivation condition for the pump 6, based on sensor signals.

Figure 4A:
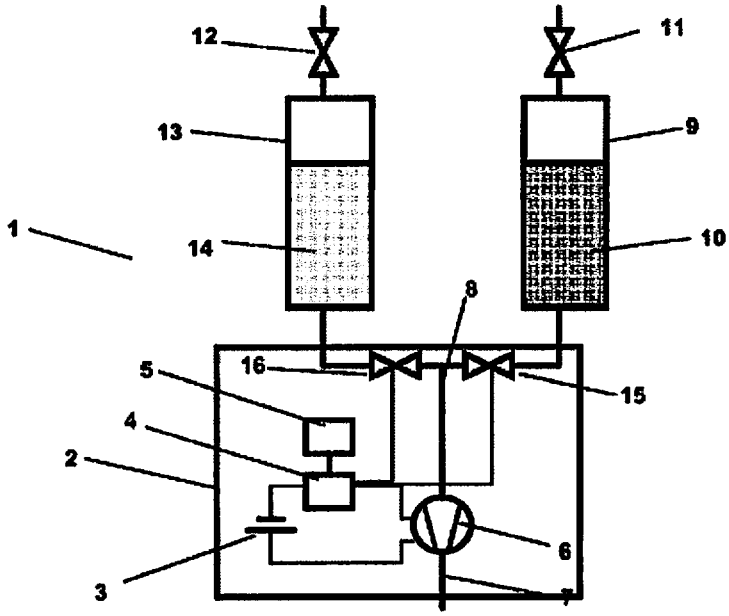

As shown in FIG. 4*a*, it is also possible to design the valves 15 and 16 as components actively controlled by the control unit 4. The mixing ratio of the two preparations 10 and 14 may thus be influenced actively and in a time-variant manner.

The control for this embodiment is shown in FIG. 7 as a flow chart 30.

FIG. 5 shows another possibility for active and time-variant influencing of the mixing ratio. In this embodiment of the invention, each containers 9 and 13 is coupled to a pump 6 and 19 individually regulated by the control unit 4. FIG. 8 shows the corresponding control algorithm.

FIG. 9 shows the dosing device from FIG. 1 wherein an RFID label 42 suitable for identifying the size and contents 10 of the container 9 is provided on the container 9.

The sensor unit 5 comprises an RFID receiver unit, which is able to read out the information from the RFID label 42 provided on the container 9. This information is sent as a control signal to the control unit 4 to induce dosing of the preparation 10 based on the contents of the container 9. In particular, control signals induced by the RFID label 42 can be used to select a dosing program stored in the control unit.

In this manner, a universal dosing device for a variety of dosing applications can be provided, such as dosing of preparations in dishwashers, washing machines, dryers, toilets or in residential rooms.

As an alternative to the RFID label 42, those skilled in the art may also provide other means which induce automatic identification of the container 9 and its contents 10 by the dosing device.

Furthermore, an additional dispensing device 43 may be provided on the pressure-side opening of the pressure line 7. This dispensing device 43 induces a distribution of the preparation into the surrounding environment of the dosing device 1 in a manner different from dropwise dispensing. This may involve, for example, dispensing of the preparation in the manner of a stream or spray mist or dispensing based on evaporation or diffusion. The dispensing device 43 may therefore be designed as a nozzle, atomizer, distributor plate or porous surface, for example. In particular, the dispensing device may be designed so that it counteracts gelation of the preparations released.

FIG. 10 shows the toilet freshener from FIG. 1 with a container 9 detachable from the dosing device 2. On its lower end at the bottom, the container 9 has a connection 47 which can be inserted into the receptacle 48 provided on the dosing device 1. The connection 47 can be sealed by a closure so that the preparation 10 is prevented from running out of the container 9 at first in the unused state of the container 9; however, this closure is destroyed when the container 9 is inserted into the dosing device 2 and/or the connection 47 is inserted into the receptacle 48, enabling release of the preparation 10 out of the container 9 by the dosing device 2 into the surrounding environment. FIG. 11 shows the toilet freshener in its assembled state.

The control unit 4 is also coupled to an acoustic converter 46 that converts a voltage and/or a current of the control unit into an audible acoustic signal. The control unit 4 can include memory for a plurality of acoustic signals and/or music and/or speech recordings retrieved manually or triggered by a sensor and executed (i.e., sent to the acoustic converter 46).

Furthermore, a lamp 44 can be connected to the control unit 2 and turned on and off according to a predefined operating state of the dosing unit 2. The lamp can be in the form of an LED or LCD display, for example.

The dosing device 2 can be turned on and off with the operating element 45. Furthermore, it is possible for various programs stored in the control unit 4 to be retrieved and executed via the operating element 45.

FIG. 12 shows another embodiment of the inventive toilet freshener in which the power source 3 in the form of a battery is integrated into the container 9. The battery 3 is connected in an electrically conducting manner to the dosing device 2 via a suitably designed coupling. The capacitance of the battery 3 is advantageously designed so that it supplies power to the dosing device 2 over the period of use until the preparation 10 has been completely emptied from the container 9.

FIG. 13 illustrates a design of the inventive toilet freshener, known generally from FIG. 5, shown here in a detailed schematic diagram. The chamber 9 is subdivided by the wall 49 into two chambers in which a first preparation 10 and a second preparation 14 are stored. Each chamber is connected to the surrounding environment, communicating through one pressure-equalizing valve 11 and/or 12 for each, and having a connection 47*a* and/or 47*b* at its end on the bottom side.

FIGS. 15-17 show another embodiment of the inventive toilet freshener. The toilet freshener includes the dosing device 2 and the container 9 which is detachably affixed to the dosing device 2. The dosing device has an elevated rear wall from which the fastener 52 extends vertically in the form of a bracket. The bracket 52 is positioned between the edge of the toilet and the toilet seat, where it is affixed on the toilet bowl by the toilet seat resting on it. As FIG. 17 shows, a suction cup can also be included on the dosing device, additionally securing the toilet freshener on the toilet by vacuum.

On the head side of the fastening means 52 facing upward, a pressure and/or strain measurement sensor is provided as the sensor unit 5. When a pressure is applied to this sensor unit 5 (e.g., by someone using the toilet and sitting on the toilet seat), the sensor unit 5 generates a corresponding signal which is relayed to the control unit 4 of the dosing device 2.

The container 9 is separable from the dosing device, as seen in FIG. 16. The container 9 has a wick system 50 in its interior, with which preparation is dispensed by the release element 43*a* from the container 9 to the surrounding environment by evaporation. The connection 47 and the receptacle 48 in the dosing device 2 form a liquid-tight connection in the assembled state of the container 9 and dosing device 2.

A release element 43 in the form of a nozzle head is provided on the bracket 52. The nozzle head 43 is movably arranged on the bracket 52 allowing it to be aligned by the user. The length of the bracket 52 and thus the application point of the nozzle head 43 are adjustable by a telescoping arrangement 53 arranged between the nozzle head 43 and the bracket 52. With the nozzle head 43, a spray cone 54 is created from the preparation. As FIG. 18 shows, this spray cone wets a defined application field in the toilet bowl 55.

FIG. 19 shows another alternative embodiment of the inventive toilet freshener. In this embodiment, the containers 9 and 13 are fixedly connected to the dosing device 2 and can be refilled through an opening (not shown in FIG. 19).

FIG. 20 shows a release element 43 arranged on the distal end of the bracket 52 with an integrated sensor 5 and two nozzles 56 and 57. In this exemplary embodiment, the sensor 5 is embodied as an infrared sensor or as an ultrasonic sensor.

The nozzles 56 and 57 can be configured so that they generate the same or different spray cones 54*a* and 54*b*, illustrated in FIG. 21. As shown in FIG. 22, the spray cones 54*a* and 54*b* can be directed at the same application field in the interior of a toilet bowl 55. However, it is also apparent from FIGS. 23 and 24 that it is possible to aim the two spray cones in different directions.

In the embodiment shown in FIG. 23, the release element 43 is affixed to the lower edge of the toilet bowl 55 on the inside by a hook. The release element 43 is therefore displaceably arranged on the bracket 52, symbolized by the arrow in FIG. 23. In addition, the toilet freshener 1 is affixed to the outer edge of the toilet bowl 55 by the fastener 50, here designed as a suction cup.

The release element 43 has a first nozzle 56 and a second nozzle 57 which are spaced apart from one another and arranged in the release element 43 in such a way that their respective spray cones 54*a* and 54*b* point in different directions without overlapping. For example, the spray cone 54*a* of the first nozzle 56 is directed into the interior of the toilet bowl 55 while the spray cone 54*b* of the second nozzle 57 is directed at the edge of the toilet bowl. As shown in FIG. 24, it is also possible for a spray cone 54*b* to be directed beneath the edge of the toilet bowl 55. The spray cones 54*a* and 54*b* may be formed from the same or different compositions.

A sensor unit 5 in the form of a capacitive sensor protrudes away from the release element beneath the edge of the toilet 55, enabling it to be acted upon by water when the flushing water is activated. The sensor 5 is shaped so that it does not have any significant influence on the guidance of the flushing water in the toilet bowl 55.

FIG. 25 shows another embodiment of the containers 9 and 13 and of the dosing device 2. Here, the receptacle of the containers 9 and 13 in the dosing device is closable by a flap 58 pivotably arranged on the dosing device 2. The two containers 9 and 13 may be removed from or inserted into the receptacle of the dosing device 2 separately in the opened state of the flap 58.

In another embodiment of the invention, FIG. 25 shows a toilet freshener 1 having two individually replaceable containers 9 and 13 and an inspection flap 58 in the closed and opened positions. The inspection flap 58 is hinge-connected to the back wall of the toilet freshener and is shaped so that the inspection flap 58 covers, preferably completely, the containers 9 and 13 inserted into the toilet freshener 1. The inspection flap 58 may be provided with closing means, which allow a childproof closure of the inspection flap 58 with the toilet freshener and thus prevent unintended access to the containers 9 and 13.

The lamps 44 and the operating element 45 are arranged on the front side of the toilet freshener so they are not covered when the inspection flap 58 is closed, but instead are freely accessible.

We claim:

1. A toilet freshener for introducing at least one active substance preparation into a toilet bowl, comprising:

a dosing device having a power source, a sensor unit, and a control unit, wherein at least the power source and control unit are arranged in a housing, and a bracket for attaching the dosing device to the toilet bowl, and at least a first container containing a first preparation, the first container having a connection for coupling the first container to the dosing device, wherein the connection is sealed by a closure that prevents the first preparation from running out of the container until the container is coupled to the dosing device, wherein the power source, control unit and at least the first container cooperate so that when there is a predetermined sensor signal at the control unit the first preparation is dispensed from the first container through the dosing device to the surrounding environment, wherein the first preparation has a viscosity of 3000 mPas or less, and the dosing device further comprising a pump connected to the power source and a release element, wherein the pump or release element or both is configured so that free flow of the preparation into the surrounding environment is prevented when the pump is stopped or the release element is in the closed position or both, wherein the release element is displaceably arranged on the bracket and comprises a piezo element for dispensing at least the first preparation.

2. Toilet freshener according to claim 1, wherein the container is coupled to a pressure side of the pump.

3. Toilet freshener according to claim 1, wherein the container is coupled to an intake side of the pump.

4. Toilet freshener according to claim 1 further comprising a valve arranged between the first container and the pump.

5. Toilet freshener according to claim 4, wherein the valve is actively controllable by the control unit so that a first control signal induces opening of the valve and a second control signal induces closing of the valve.

6. Toilet freshener according to claim 1 further comprising at least a second container containing a second preparation, wherein the second container can be coupled to the dosing device.

7. Toilet freshener according to claim 6 further comprising a first pump for dispensing the first preparation, wherein the first pump can be coupled to the first container, and a second pump for dispensing the second preparation, wherein the second pump can be coupled to the second container.

8. Toilet freshener according to claim 1, wherein the control unit is a programmable microcontroller.

9. Toilet freshener according to claim 8 further comprising a plurality of dosing programs stored in the microcontroller, wherein the programs are selectable and executable in accordance with the container coupled to the dosing device.

10. Toilet freshener according to claim 7, wherein the first pump or the release element or both and at least the first preparation are configured so that foam is formed when the first preparation is released into the surrounding environment.

11. Toilet freshener according to claim 1, wherein the amount of the preparation dispensed per dosing is 1 mL or less.

12. Toilet freshener according to claim 11, wherein the amount of the preparation dispensed per dosing is from 0.01 to 1 mL.

13. Toilet freshener according to claim 1, wherein a defined quantity of the preparation is dispensed from the container for 20 seconds or less.

14. Toilet freshener according to claim 1, wherein a defoaming agent is dispensed into the toilet bowl before or during flushing.

15. Toilet freshener according to claim 1, wherein the release element further comprises the sensor unit for detecting water flushed from the toilet bowl.

16. Toilet freshener according to claim 1, wherein the release element further comprises a first nozzle and a second nozzle, wherein the first preparation is dispersed through the first nozzle or the second nozzle or both into the toilet bowl.

17. Toilet freshener according to claim 1, wherein the sensor unit further comprises an RFID receiver unit able to read information from an RFID label on the first container and wherein the sensor unit is arranged in the housing.

* * * * *